US010276005B2

(12) United States Patent
Bell et al.

(10) Patent No.: US 10,276,005 B2
(45) Date of Patent: Apr. 30, 2019

(54) SHRINK WRAPPED ADVERTISING FOR FIRE HYDRANTS AND FIXTURES

(71) Applicants: Raymond John Bell, Coral Springs, FL (US); John Edward McLoughlin, North Miami Beach, FL (US)

(72) Inventors: Raymond John Bell, Coral Springs, FL (US); John Edward McLoughlin, North Miami Beach, FL (US)

( * ) Notice: Subject to any disclaimer, the term of this patent is extended or adjusted under 35 U.S.C. 154(b) by 0 days.

(21) Appl. No.: 15/957,903

(22) Filed: Apr. 19, 2018

(65) Prior Publication Data

US 2018/0240314 A1 Aug. 23, 2018

Related U.S. Application Data

(62) Division of application No. 15/094,983, filed on Apr. 8, 2016, now abandoned.

(60) Provisional application No. 62/287,868, filed on Jan. 27, 2016.

(51) Int. Cl.

| | |
|---|---|
| ***G08B 7/06*** | (2006.01) |
| ***E03B 9/04*** | (2006.01) |
| ***G08B 1/08*** | (2006.01) |

(52) U.S. Cl.

CPC ..... *G08B 7/06* (2013.01); *E03B 9/04* (2013.01); *G08B 1/08* (2013.01)

(58) Field of Classification Search

CPC ... G08B 7/06; G08B 1/08; G01M 3/00; E03B 9/04; E03B 9/06

USPC ..... 340/7.55

See application file for complete search history.

(56) References Cited

U.S. PATENT DOCUMENTS

| | | | | |
|---|---|---|---|---|
| 4,756,415 | A * | 7/1988 | Call | B65D 75/004 206/497 |
| 9,593,999 | B2 * | 3/2017 | Fleury, Jr. | G01M 3/00 |
| 2008/0076593 | A1 * | 3/2008 | Costa | A63B 53/00 473/316 |
| 2014/0077949 | A1 * | 3/2014 | Brinkley | F41H 1/02 340/541 |
| 2017/0211258 | A1 * | 7/2017 | Bell | G08B 7/06 |

* cited by examiner

*Primary Examiner* — Ali Neyzari

(74) *Attorney, Agent, or Firm* — Wei Wei Jeang; Grable Martin Fulton PLLC

(57) ABSTRACT

A shrink wrap film for wrapping about a fixture such as a fire hydrant includes a plurality of film layers, a processor embedded between two film layers, a transceiver coupled to the processor and configured to receive and transmit wireless communication signals, an audio/visual interface element coupled to the processor and configured to be activated in response to the transceiver receiving a wireless activation signal, and wherein at least one of the plurality of film layers incorporates visual advertising content.

14 Claims, 6 Drawing Sheets

SHRINK WRAPPED ADVERTISING FOR FIRE HYDRANTS AND FIXTURES

RELATED PATENT APPLICATION

This is a divisional application of U.S. application Ser. No. 15/094,983 filed on Apr. 8, 2016, which claims the benefit of U.S. Provisional Application No. 62/287,868 filed on Jan. 27, 2016, which is incorporated herein by reference.

FIELD

The present disclosure relates to the field of advertising, and in particular shrink wrapped advertising for fixtures such as fire hydrants.

BACKGROUND

Shrink-wrap films have been made of polymer plastics to protect the underlying surface, such as in sealing food containers, scuba tanks, and even batteries, as disclosed in U.S. Pat. No. 4,756,415 entitled "Shrink Wrap Battery Package."

Shrink wrap has also been applied to the exterior of vehicles, described in U.S. Pat. No. 5,518,786 entitled "Exterior Automotive Laminate with Pressure Sensitive Adhesive."

Shrink wrap films have also been applied to other objects such as golf clubs, as described in U.S. 2008/0,076,593 and entitled "Customized Golf Clubs and Method for Making Same."

DETAILED DESCRIPTION

Figure 1:
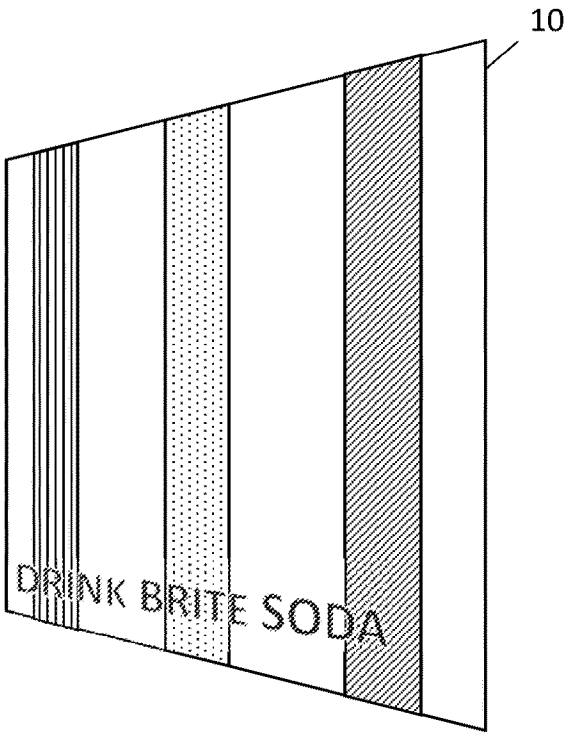
FIG. 1 is an illustration of a shrink wrap film for application to a fire hydrant according to the teachings of the present disclosure.

FIG. 1 is an illustration of a shrink wrap film 10 for application to a fire hydrant 12 according to the teachings of the present disclosure. Fire hydrants are ubiquitous fixtures on urban streets that allow firefighters to tap into a water supply for fire protection. Fire hydrants are typically made from a metal such as grey or ductile iron. The exterior of fire hydrants is usually painted a bright red color with conventional paint. The current invention contemplates applying a shrink wrap film 10 bearing advertising content to fire hydrants 12, possibly as a revenue source for city governments or other entities.

The shrink wrap film 10 may be made from a polymer plastic of various materials suitable for tentering, printing, and subsequent shrinking, including but not limited to copolyesters, polyvinylchloride (PVC), polyvinylidene fluoride (PVDF), polylactide (PLA), and thermoplastic styrene-butadiene copolymers (Styrolux). The film 10 preferably is made from a thermoplastic that can be heated and extruded into a thin film. The film 10 can be a single flat sheet with incorporated tape to join the ends or edges, or it may be a film cylinder that can be easily slid over the hydrant to be formed and shrunken by the application of heat. Because of the irregular shape of the fire hydrant, the film 10 may be cut, contoured, and/or shaped in advance and then installed onto the fire hydrant 12.

At a microscopic level, the long, thin polymer molecules are lined up in rows. When the heat or pressure is applied, the molecules vibrate against one another and begin to tangle and twist together. This action decreases the volume of the shrink-wrap film, causing the film to tightly wrap and cling to the fire hydrant.

The shrink wrap film 10 may be constructed using a multi-layer construction, where each layer may be a transparent, translucent, or opaque material. One or more layers of the film may include visual patterns, static images, logos, printed text, graphical text, seasonal decorations, or optical devices such as holographic images, holographic textures, optical lenses, and the like, separately or in combination thereof. The shrink wrap film 10 may further incorporate tactile textures and patterns. Further, one or more layers of the film may incorporate optical reflective devices that is arranged to bounce incident light back out for esthetic and/or safety purposes. The film 10 will also protect the fire hydrant from the elements, helping to reduce the frequency that the fire hydrant needs to be repainted.

Figure 2:
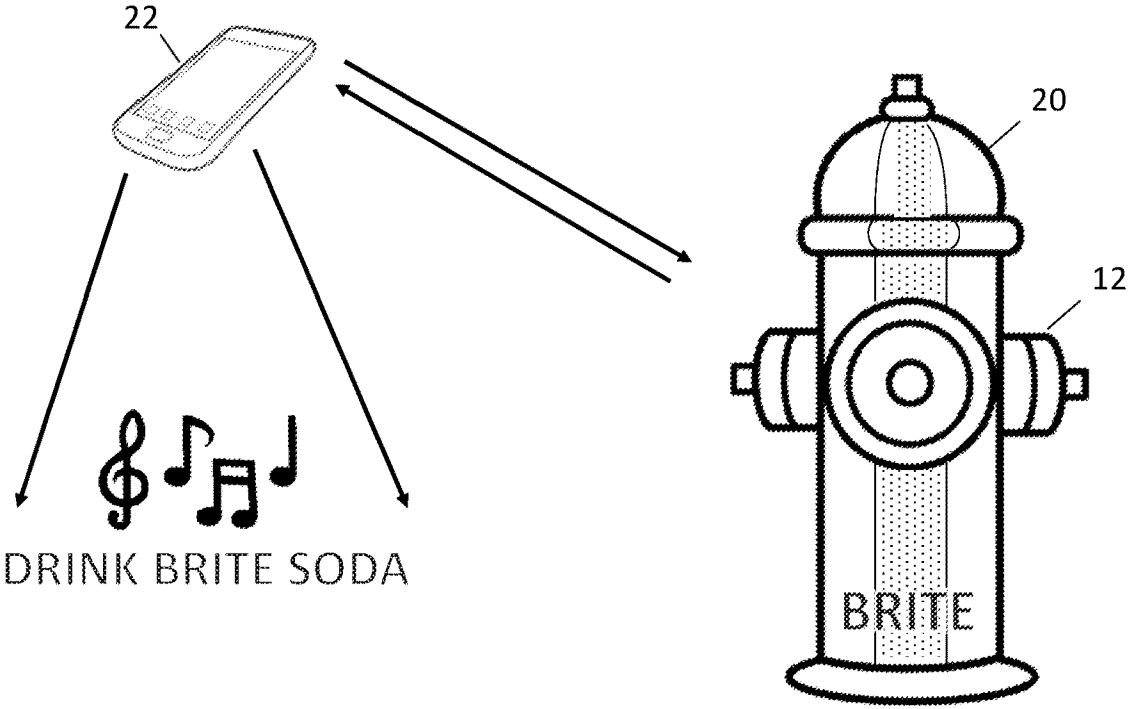
FIG. 2 is another illustration of a shrink wrap film applied to a fire hydrant configured to elicit an audio response from a smartphone according to the teachings of the present disclosure.
Figure 3:
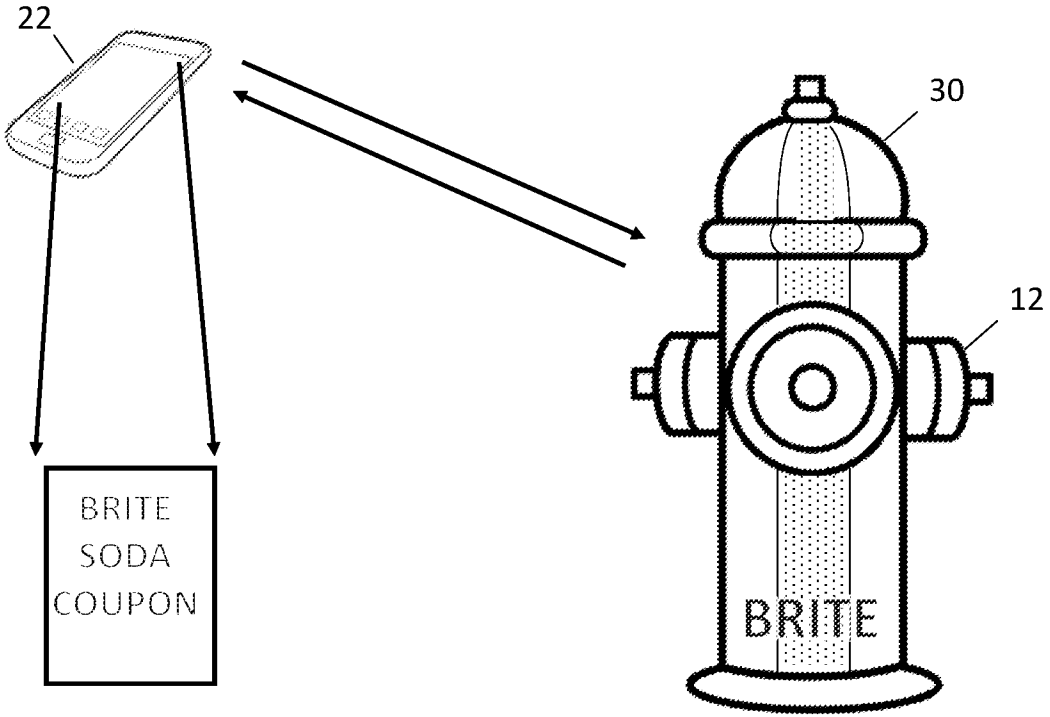
FIG. 3 is another illustration of a shrink wrap film applied to a fire hydrant configured to elicit a visual response from a smartphone according to the teachings of the present disclosure.
Figure 4:
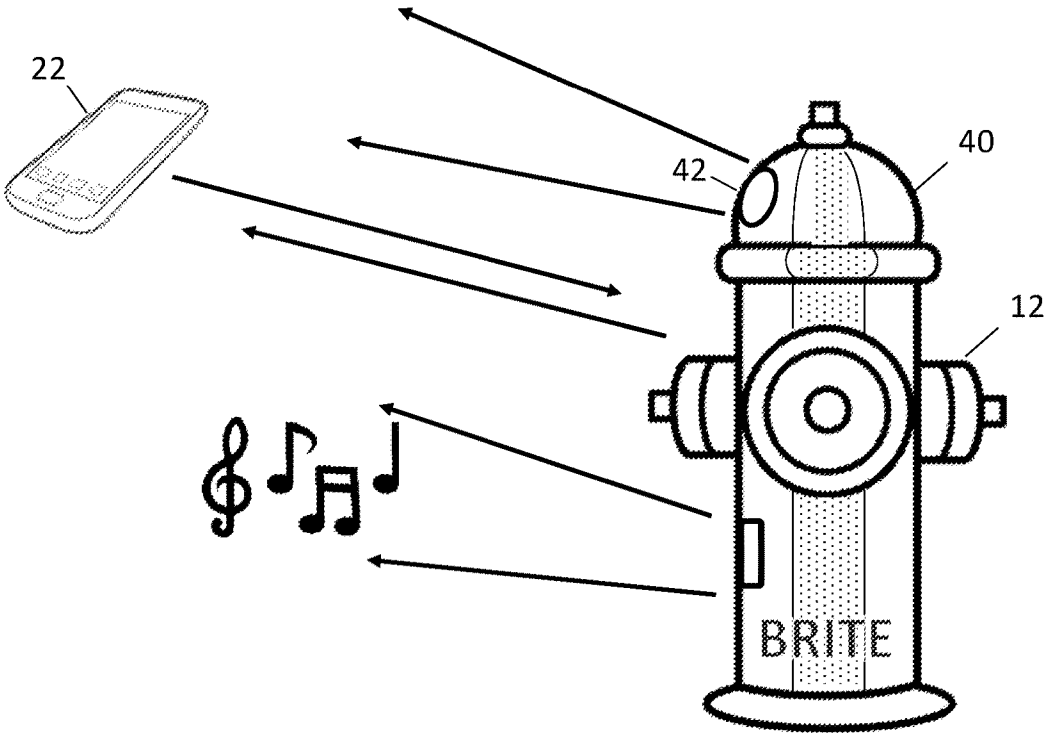
FIG. 4 is another illustration of a shrink wrap film applied to a fire hydrant configured to produce an audio and visual response from a transmission from a smartphone according to the teachings of the present disclosure.

FIG. 2 is another illustration of a shrink wrap film 20 applied to a fire hydrant 12 configured to elicit an audio response from a smartphone 22 according to the teachings of the present disclosure. The shrink wrap film 20 may further incorporate passive electronic devices that are configured to cause a smartphone 22 (or another computing device capable of wireless communications) carried by a pedestrian that comes within a predetermined range of the fire hydrant 12 to undertake certain action. For example, the smartphone 22 may automatically access an Internet location to automatically download advertising content, such as an audio message or song, that is automatically played over the smartphone's speakers. As another example shown in FIG. 3, the smartphone 22 may automatically access an Internet location to automatically download another form of advertising content, such as a shopping coupon for a manufacturing or retail entity, that is automatically displayed on the smartphone's screen. Yet another example, shown in FIG. 4, contemplates the smartphone 22 detecting the existence of the fire hydrant 12 and causes the shrink wrap film 40 that includes circuitry configured to play or display advertising content, such as a commercial jingle, a popular song, or audio message. The shrink wrap film 40 may also incorporate visual elements 42 such as lighting elements of one or more colors and shapes, a display screen, spotlights, beacons, etc. to provide information, attract attention, and/or provide scene lighting.

It is further contemplated herein that the shrink wrap film may incorporate circuitry that is configured to broadcast or transmit fire hydrant location and status (e.g., water in the hydrant when the hydrant is off). In another embodiment, the shrink wrap film may incorporate a traffic signal preemption receiver that is receptive to the traffic preemption activation signal (e.g., acoustic, line-of-sight, global positioning system (GPS), and localized FHSS (Frequency Hopping Spread Spectrum) radio frequency (RF) signals) emitted by an emergency vehicle and fire trucks. Upon detecting a traffic preemption activation signal emitted by a fire truck 44 (FIG. 5), the circuitry in the shrink wrap film may emit a response RF signal or beacon (or another form of visual cue) that aids the firefighting personnel in locating the fire hydrant quickly and efficiently. The RF signal or beacon may cause an app on the smartphone to display a map and the location of nearby fire hydrants. The shrink wrap film may additionally activate a beacon or scene lighting also incorporated in the shrink wrap film upon detection of emergency vehicles 44 in close proximity.

Figure 5:
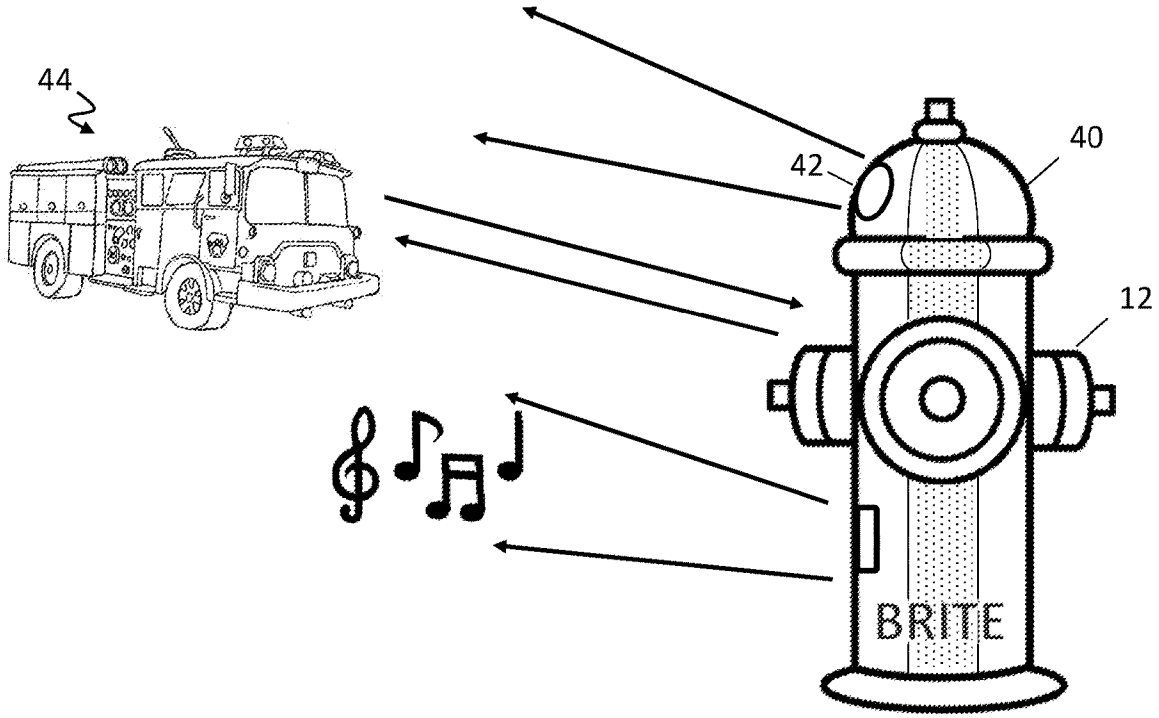
FIG. 5 is another illustration of a shrink wrap film applied to a fire hydrant configured to produce an audio and visual response from a transmission from an emergency vehicle according to the teachings of the present disclosure.
Figure 6:
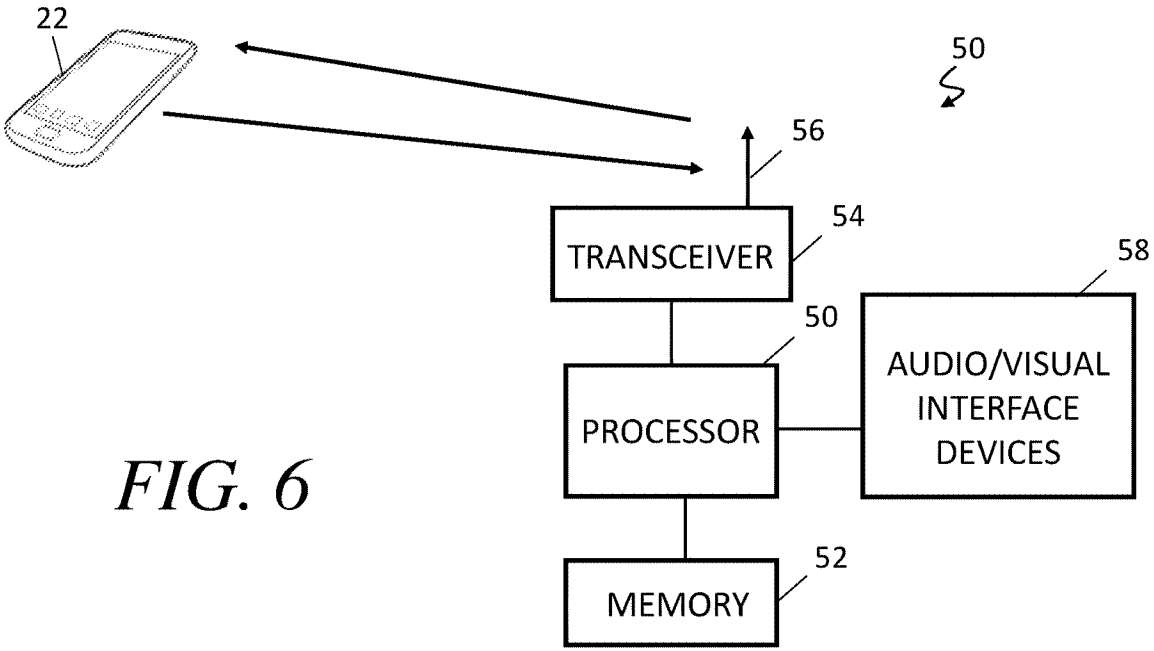
FIG. 6 is a simplified block diagram of an exemplary embodiment of a circuitry incorporated into the shrink wrap film applied to a fire hydrant according to the teachings of the present disclosure.

FIG. 5 is a simplified block diagram of an exemplary embodiment of a circuitry 50 incorporated into the shrink wrap film 10 applied to a fire hydrant according to the teachings of the present disclosure. The circuitry 50 includes a processor 50 configured to execute a plurality of computer instructions and access stored data in one or more memory devices 52 (RAM, ROM, EEPROM, etc.). The circuitry 50 further includes a transceiver 54 and antenna 56 for receiving and transmitting data with the smartphone and/or emergency vehicles. Any suitable short range wireless communication technology may be used, such as ANT+, IEEE 802.15.4, IEEE 802.22, ISA 100a, RFID, Bluetooth, Near Field Communications (NFC), Infrared, UWB, WirelessHD, WirelessUSB, ZigBee, WiFi, WiFi Direct, FHSS (Frequency Hopping Spread Spectrum) short-range radio signal, etc. The circuitry 50 further includes audio/visual interface devices 58, such as lighting elements, display elements, display screens, speakers, etc.

The circuitry 50 may include a power source (e.g., solar) or function like a passive RFID circuit that draws energy from the received RF signal emitted from the smartphone and/or emergency vehicle.

The features of the present invention which are believed to be novel are set forth below with particularity in the appended claims. However, modifications, variations, and changes to the exemplary embodiments described above will be apparent to those skilled in the art, and the shrink wrapped advertising on fire hydrants described herein thus encompasses such modifications, variations, and changes and are not limited to the specific embodiments described herein.

What is claimed is:

1. A shrink wrap film comprising:

a plurality of film layers;

a transceiver configured to receive and transmit wireless communication signals;

an audio/visual interface element coupled to the transceiver and configured to be activated in response to the transceiver receiving a wireless activation signal; and wherein at least one of the plurality of film layers incorporates visual advertising content.

2. The shrink wrap film of claim 1, wherein the shrink wrap film is tightly wrapped around a fixture, and the transceiver is configured to wirelessly communicate with a smartphone located within a predetermined range of the fixture, and automatically transmit data to the smartphone.

3. The shrink wrap film of claim 1, wherein the shrink wrap film is tightly wrapped around a fixture, and the transceiver is configured to wirelessly communicate with a smartphone located within a predetermined range of the fixture, and automatically transmit data to the smartphone to cause the smartphone to automatically provide one of audio and visual advertising content.

4. The shrink wrap film of claim 1, wherein the shrink wrap film is tightly wrapped around a fixture, and the transceiver is configured to wirelessly communicate with a smartphone located within a predetermined range of the fixture, and automatically transmit data to the smartphone to cause the smartphone to automatically access information over the Internet and automatically display data downloaded over a global computer network.

5. The shrink wrap film of claim 1, wherein the shrink wrap film is tightly wrapped around a fixture, and the transceiver is configured to wirelessly communicate with a smartphone located within a predetermined range of the fixture, and automatically cause the audio/visual interface element to provide one of audio and visual advertising content in response to detecting the smartphone.

6. The shrink wrap film of claim 1, wherein the shrink wrap film is tightly wrapped around a fixture, and the transceiver is configured to wirelessly communicate with a traffic preemption signal emitted by an emergency vehicle, and automatically cause the audio/visual interface element to provide one of audio and visual information in response to detecting the emergency vehicle.

7. The shrink wrap film of claim 1, further comprising a processor embedded between two film layers and coupled to the transceiver and audio/visual interface element.

8. A shrink wrap film comprising:

at least two film layers;

a transceiver embedded between the at least two film layers and configured to receive and transmit wireless communication signals;

an audio/visual interface element in communication with the transceiver and configured to be activated to present audio/visual data in response to the transceiver receiving a wireless activation signal; and wherein at least one of the at least two film layers incorporates visual advertising content.

9. The shrink wrap film of claim 8, wherein the shrink wrap film is tightly wrapped around a fixture, and the transceiver is configured to wirelessly communicate with a smartphone located within a predetermined range of the fixture, and automatically transmit data to the smartphone.

10. The shrink wrap film of claim 9, wherein the shrink wrap film is tightly wrapped around a fixture, and the transceiver is configured to wirelessly communicate with a smartphone located within a predetermined range of the fixture, and automatically transmit data to the smartphone to cause the smartphone to automatically provide one of audio and visual advertising content.

11. The shrink wrap film of claim 9, wherein the shrink wrap film is tightly wrapped around a fixture, and the transceiver is configured to wirelessly communicate with a smartphone located within a predetermined range of the fixture, and automatically transmit data to the smartphone to cause the smartphone to automatically access information over the Internet and automatically display data downloaded over a global computer network.

12. The shrink wrap film of claim 8, wherein the shrink wrap film is tightly wrapped around a street fixture, and the transceiver is configured to wirelessly communicate with a smartphone located within a predetermined range of the fixture, and automatically cause the audio/visual interface element to present one of audio and visual advertising content in response to detecting the smartphone.

13. The shrink wrap film of claim 8, wherein the shrink wrap film is tightly wrapped around a street fixture, and the transceiver is configured to wirelessly communicate with a traffic preemption signal emitted by an emergency vehicle, and automatically cause the audio/visual interface element to provide one of audio and visual information in response to detecting the emergency vehicle.

14. The shrink wrap film of claim 8, further comprising a processor embedded between two film layers and coupled to the transceiver and audio/visual interface element.

* * * * *